US010573266B2

(12) United States Patent
Tseng et al.

(10) Patent No.: US 10,573,266 B2
(45) Date of Patent: Feb. 25, 2020

(54) DISPLAY PANEL DRIVING APPARATUS AND METHOD FOR COMPENSATING PIXEL VOLTAGE

(71) Applicant: HIMAX TECHNOLOGIES LIMITED, Tainan (TW)

(72) Inventors: Yih-Long Tseng, Tainan (TW); Ming-Cheng Chiu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 252 days.

(21) Appl. No.: 15/671,167

(22) Filed: Aug. 8, 2017

(65) Prior Publication Data

US 2019/0051261 A1 Feb. 14, 2019

(51) Int. Cl.
*G09G 3/36* (2006.01)

(52) U.S. Cl.
CPC ..... *G09G 3/3659* (2013.01); *G09G 3/3611* (2013.01); *G09G 3/3629* (2013.01); *G09G 3/3655* (2013.01); *G09G 3/3614* (2013.01); *G09G 2320/0209* (2013.01); *G09G 2320/0285* (2013.01)

(58) Field of Classification Search
CPC .. G09G 3/3659; G09G 3/3611; G09G 3/3629; G09G 3/3655
USPC ..... 345/89
See application file for complete search history.

(56) References Cited

U.S. PATENT DOCUMENTS

2006/0093236 A1* 5/2006 Drezner ..... G06T 5/002 382/272
2006/0284811 A1 12/2006 Huang
2009/0129697 A1* 5/2009 Chang ..... G09G 3/003 382/274
2012/0249620 A1* 10/2012 Choi ..... G09G 3/3648 345/694
2013/0271682 A1 10/2013 Liou et al.
2015/0194107 A1* 7/2015 Bae ..... G09G 3/3607 345/696
2016/0240128 A1* 8/2016 Kim ..... G09G 3/2007
2017/0092191 A1* 3/2017 An ..... G09G 3/3233

FOREIGN PATENT DOCUMENTS

TW 200802242 1/2008
TW 201610962 3/2016

OTHER PUBLICATIONS

"Office Action of Taiwan Counterpart Application", dated Mar. 6, 2018, p. 1-p. 3, in which the listed references were cited.

* cited by examiner

*Primary Examiner* — Jonathan M Blancha
(74) *Attorney, Agent, or Firm* — JCIPRNET

(57) ABSTRACT

A display panel driving apparatus and method are provided. The display panel driving apparatus includes a timing control circuit, a memory, a compensation circuit and a data driving circuit. The memory provides at least one coupling-capacitance information between a current pixel and at least one adjacent pixel in a display panel. By using the coupling-capacitance information, the compensation circuit compensates the current pixel data to obtain the compensated pixel data for compensating the voltage offset of the current pixel caused by the coupling voltage of the adjacent pixel. The data driving circuit drives the current pixel according to the compensated pixel data.

16 Claims, 4 Drawing Sheets

DISPLAY PANEL DRIVING APPARATUS AND METHOD FOR COMPENSATING PIXEL VOLTAGE

BACKGROUND

Field of the Invention

The invention relates to a display apparatus and more particularly, to a display panel driving apparatus and a method for compensating a pixel voltage.

Description of Related Art

When liquid crystal on silicon (LCoS) is applied in a general display purpose, uniformity of the same gray level may draw more attention, and a voltage difference among pixels may be tolerable in a displayed image. When the LCoS is applied in phase modulation applications, the voltage difference among the pixels would draw more attention as the voltage difference among the pixels may dramatically cause affection to imaging quality. In any case, that is because there must be coupling capacitance existing between adjacent pixels. The coupling capacitance may cause the voltage difference to the pixels. As a distance/gap between adjacent pixels decreases, the coupling capacitance between the adjacent pixels increases. The pixel voltage is affected by the coupling capacitance of the adjacent pixels, such that the voltage difference among the pixels gets much more serious. So far, no adaptive solution toward the voltage difference between the pixels caused by the coupling capacitance between the adjacent pixels is provided in the related art.

SUMMARY

The invention provides a display panel driving apparatus and method for compensating a voltage offset of a current pixel caused by coupling voltages of adjacent pixels.

According to an embodiment of the invention, a display panel driving apparatus is provided. The display panel driving apparatus includes a timing control circuit, a memory, a compensation circuit and a data driving circuit. The timing control circuit is configured to provide current pixel data of a current pixel in a display panel. The memory is configured to provide at least one coupling-capacitance information between the current pixel and at least one adjacent pixel in the display panel. The compensation circuit is coupled to the timing control circuit to receive the current pixel data. The compensation circuit is coupled to the memory to receive the coupling-capacitance information. By using the coupling-capacitance information, the compensation circuit is configured to compensate the current pixel data to obtain compensated pixel data for compensating a voltage offset of the current pixel caused by a coupling voltage of the at least one adjacent pixel. The data driving circuit is coupled to the current pixel in the display panel. The data driving circuit is coupled to the compensation circuit to receive the compensated pixel data. The data driving circuit is configured to drive the current pixel according to the compensated pixel data.

According to an embodiment of the invention, a display panel driving method is provided. The display panel driving method includes: providing, by a timing control circuit, current pixel data of a current pixel in a display panel; providing, by a memory, at least one coupling-capacitance information between the current pixel and at least one adjacent pixel in the display panel; compensating, by a compensation circuit, the current pixel data by using the at least one coupling-capacitance information to obtain compensated pixel data for compensating a voltage offset of the current pixel caused by a coupling voltage of the at least one adjacent pixel; and driving, by a data driving circuit, the current pixel according to the compensated pixel data.

Based on the above, in the display panel driving apparatus and method provided by the embodiments of the invention, the memory can provide the at least one coupling-capacitance information between the current pixel and the at least one adjacent pixel in the display panel. By using the coupling-capacitance information, the compensation circuit can compensate the current pixel data to obtain the compensated pixel data. Thereby, the display panel driving apparatus can compensate the voltage offset of the current pixel caused by the coupling voltage of the adjacent pixels.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
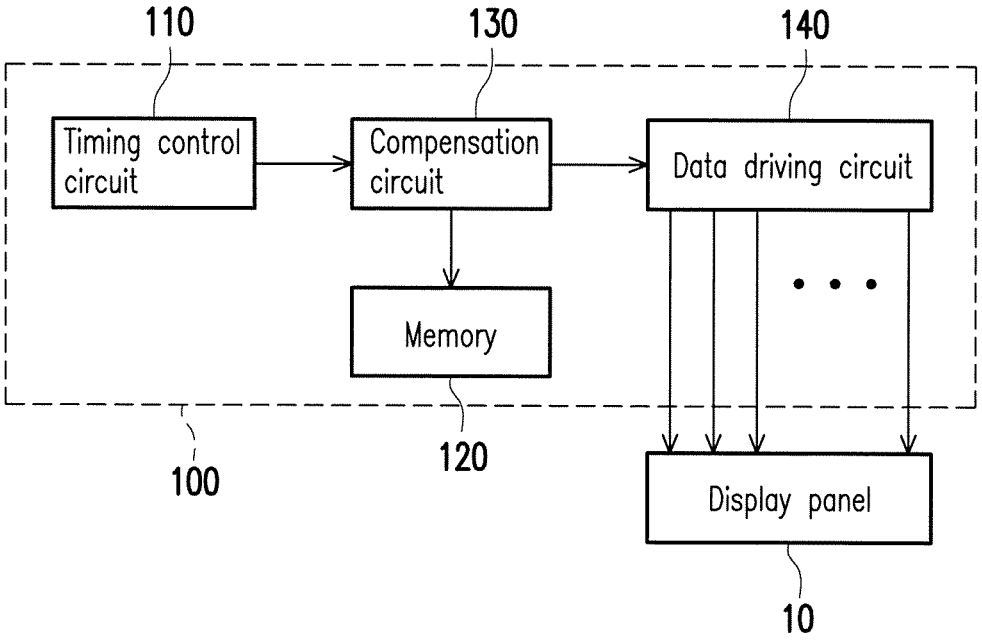
FIG. 1 is a schematic circuit block diagram illustrating a display panel driving apparatus according to an embodiment of the invention.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referral numerals in the drawings and description refer to the same or like parts. Components/members/steps using the same referral numerals or using the same terms in different embodiments may cross-refer related descriptions.

FIG. 1 is a schematic circuit block diagram illustrating a display panel driving apparatus 100 according to an embodiment of the invention. The display panel driving apparatus 100 may drive a display panel 10. Based on a design requirement, the display panel 10 may be a conventional LCoS display panel, a liquid crystal display (LCD) panel or other display panels. The display panel driving apparatus 100 includes a timing control circuit 110, a memory 120, a compensation circuit 130 and a data driving circuit 140.

Figure 2:
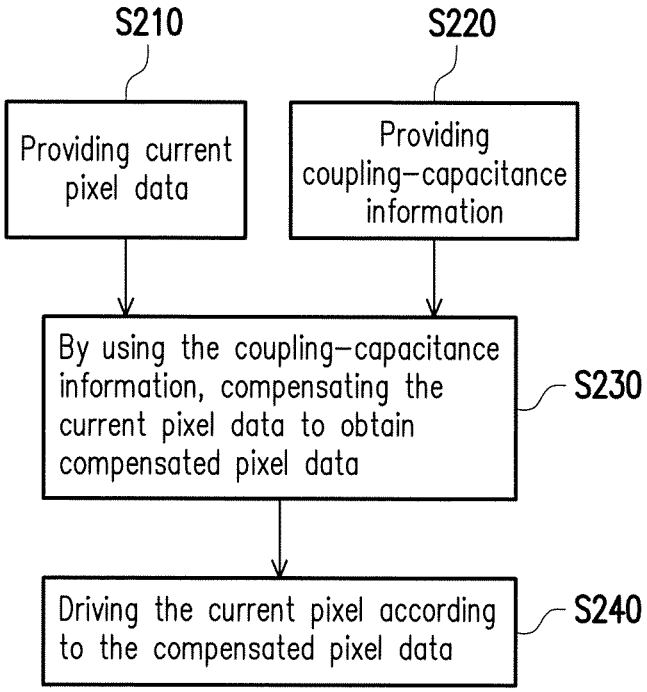
FIG. 2 is a flowchart illustrating a display panel driving method according to an embodiment of the invention.

FIG. 2 is a flowchart illustrating a display panel driving method according to an embodiment of the invention. Refer to FIG. 1 and FIG. 2. In step S210, the timing control circuit 110 may provide data of a plurality of pixels of the display panel 10 to the compensation circuit 130. For instance, the timing control circuit 110 may, in step S210, provide current pixel data of a specific current pixel in the display panel 10 to the compensation circuit 130. Based on a design requirement, the timing control circuit 110 may be a conventional timing controller or any other pixel data processing circuit/device. In step S220, the memory 120 may provide at least one coupling-capacitance information between the current pixel and the at least one adjacent pixel in the display panel 10 to the compensation circuit 130.

Figure 3:
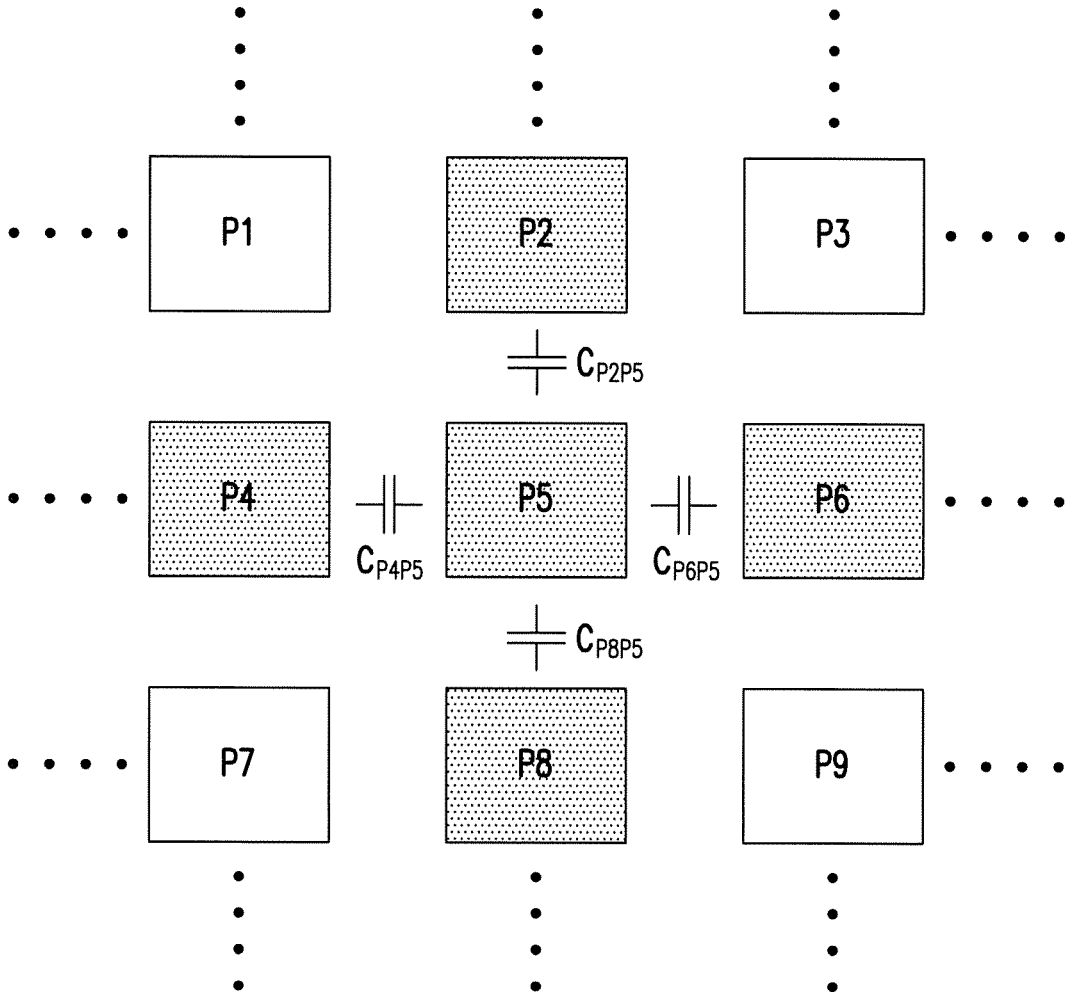
FIG. 3 is a schematic diagram illustrating a part of pixels of the display panel depicted in FIG. 1 according to an embodiment of the invention.

FIG. 3 is a schematic diagram illustrating a part of pixels of the display panel 10 depicted in FIG. 1 according to an embodiment of the invention. The display panel 10 includes a plurality of pixels, for example, a pixel P1, a pixel P2, a pixel P3, a pixel P4, a pixel P5, a pixel P6, a pixel P7, a pixel P8 and a pixel P9, as illustrated in FIG. 3. A distance/gap between each two adjacent pixels illustrated in FIG. 3 is exaggerated. Based on an actual design requirement, the distance/gap between each two adjacent pixels is usually small. A coupling capacitance (parasitic capacitance) exists between each two adjacent pixels. For instance, a coupling capacitance $C_{P2P5}$ exists between the pixel P2 and the pixel P5, a coupling capacitance $C_{P4P5}$ exists between the pixel P4 and the pixel P5, a coupling capacitance $C_{P6P5}$ exists between the pixel P6 and the pixel P5, and a coupling capacitance $C_{P8P5}$ exists between the pixel P8 and the pixel P5, as illustrated in FIG. 3. When the pixel P5 is the current pixel, the memory 120 may, in step S220, provide coupling-capacitance information corresponding to the coupling capacitances $C_{P2P5}$, $C_{P4P5}$, $C_{P6P5}$ and $C_{P8P5}$ to the compensation circuit 130.

The compensation circuit 130 is coupled to the timing control circuit 110 to receive current pixel data of the current pixel P5. The compensation circuit 130 is coupled to the memory 120 to receive the coupling-capacitance information. By using the coupling-capacitance information, the compensation circuit 130 may, in step S230, compensate the current pixel data of the current pixel P5 to obtain compensated pixel data, thereby compensating a voltage offset of the current pixel P5 caused by coupling voltages of the adjacent pixels P2, P4, P6 and P8.

The data driving circuit 140 is coupled to a plurality of pixels (e.g., the current pixel P5 and other pixels illustrated in FIG. 3) in the display panel 10. The data driving circuit 140 is coupled to the compensation circuit 130 to receive the compensated pixel data. In step S240, the data driving circuit 140 may drive the current pixel P5 of the display panel 10 according to the compensated pixel data. Based on a design requirement, the data driving circuit 140 may be a conventional data driver, a conventional source driver or any other driving circuit/device. With the consideration of voltage changes of the adjacent pixels, the compensation circuit 130 may pre-change the pixel data (e.g., a gray level value) of the current pixel P5. By means of pre-compensation, the display panel driving apparatus 100 may effectively reduce voltage difference among the pixels.

For instance, in some embodiments, by using the coupling-capacitance information and by using a gray level difference between the current pixel (e.g., the pixel P5 illustrated in FIG. 3) and each adjacent pixel (e.g., the pixel P2, P4, P6 or P8 illustrated in FIG. 3), the compensation circuit 130 may compensate the current pixel data to obtain the compensated pixel data. For descriptive convenience, a normally white LCoS display panel serving as the display panel 10 is taken as an example for description, but the implementation manner of the display panel 10 is not limited thereto.

Figure 4:
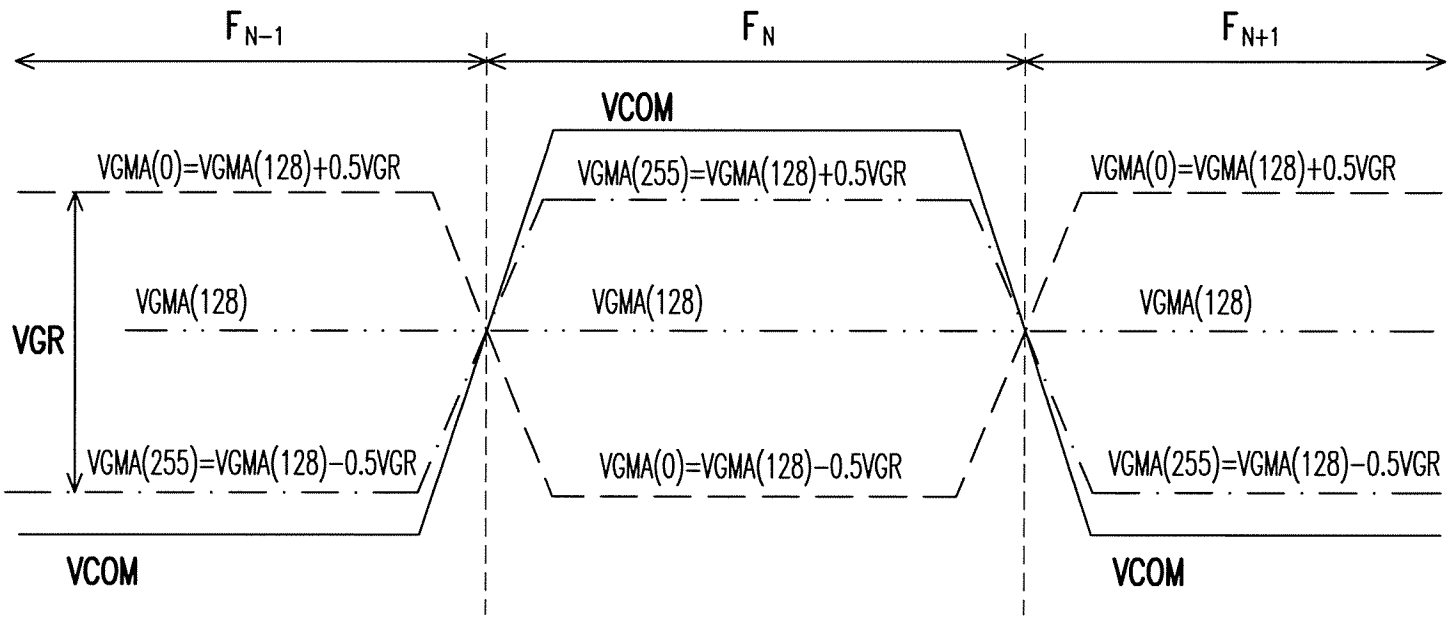
FIG. 4 is a schematic diagram illustrating polarity conversion of signals of the display panel depicted in FIG. 1 according to an embodiment of the invention.

FIG. 4 is a schematic diagram illustrating polarity conversion of signals of the display panel 10 depicted in FIG. 1 according to an embodiment of the invention. In FIG. 4, the horizontal axis represents the time, and the vertical axis represents the voltage. In the embodiment illustrated in FIG. 4, a common voltage VCOM of the display panel 10 may be an alternating-current (AC) voltage. For instance, the common voltage VCOM may be a low-level voltage (e.g., 0 V) in a previous frame $F_{N-1}$, and thus, the previous frame $F_{N-1}$ has a positive polarity. In a current frame $F_N$, the common voltage VCOM may be transformed into a high-level voltage (e.g., 6 V), and thus, the current frame $F_N$ has a negative polarity. The other frames may be derived with reference to the descriptions related to the previous frame $F_{N-1}$ and the current frame $F_N$ and thus, will not be repeated.

In the embodiment illustrated in FIG. 4, it is assumed that each pixel data is data of 8 bits, and thus, a gray level range of the pixel data is from 0 to 255. If the gray level of the pixel data is 0, its corresponding gray level voltage is VGMA(0). If the gray level of the pixel data is 128, its corresponding gray level voltage is VGMA(128). If the gray level of the pixel data is 255, its corresponding gray level voltage is VGMA(255). A voltage difference between the gray level voltage VGMA(0) and the gray level voltage VGMA(255) (which refers to a maximum pixel voltage range) is VGR, as illustrated in FIG. 4.

Referring to FIG. 3 and FIG. 4, if it is assumed that a gray level of the current pixel P5 is M, a voltage change of the current pixel P5 from the frame $F_{N-1}$ to the frame $F_N$ is approximately VGR*(M−128)/128, and the voltage change from the frame $F_N$ to the frame $F_{N+1}$ is approximately VGR*(128−M)/128. If it is assumed that a gray level of the adjacent pixel P2 is Q, a voltage change of the adjacent pixel P2 from the frame $F_{N-1}$ to the frame $F_N$ is approximately VGR*(Q−128)/128, and the voltage change from the frame $F_N$ to the frame $F_{N+1}$ is approximately VGR*(128−Q)/128. The other adjacent pixels P4, P6 and P8 may be derived with reference to the description related to the adjacent pixel P2 and thus, will not be repeated.

An application example of a static image will be set forth hereinafter. Refer to FIG. 1, FIG. 3 and FIG. 4. The compensation circuit 130 may calculate Formula 1 below to obtain a compensation value $ERR_{P5}$. By using the compensation value $ERR_{P5}$, the compensation circuit 130 may compensate current pixel data $M_{P5}$ of the current pixel P5 to obtain compensated pixel data $COMP_{P5}$, as illustrated by Formula 2. In Formula 1, $PAR_2$ represents coupling-capacitance information between the current pixel P5 and the first adjacent pixel P2, $PAR_4$ represents coupling-capacitance information between the current pixel P5 and the second adjacent pixel P4, $PAR_6$ represents coupling-capacitance information between the current pixel P5 and the third adjacent pixel P6, $PAR_8$ represents coupling-capacitance information between the current pixel P5 and the fourth adjacent pixel P8, $Q_{P2}$ represents pixel data of the first adjacent pixel P2, $Q_{P4}$ represents pixel data of the second adjacent pixel P4, $Q_{P6}$ represents pixel data of the third adjacent pixel P6, $Q_{P8}$ represents pixel data of the fourth adjacent pixel P8, and $PAR_{52}$, $PAR_{54}$, $PAR_{56}$, $PAR_{58}$ and $PAR_5$ are real numbers. Values of $PAR_{52}$, $PAR_{54}$, $PAR_{56}$, $PAR_{58}$ and $PAR_5$ may be determined based on a design requirement.

$$ERR_{P5}=PAR_2*(M_{P5}-Q_{P2})+PAR_{52}+PAR_4*(M_{P5}-Q_{P4})+PAR_{54}+PAR_6*(M_{P5}-Q_{P6})+PAR_{56}+PAR_8*(M_{P5}-Q_{P8})+PAR_{58}+PAR_5 \quad \text{Formula 1}$$

$$COMP_{P5}=M_{P5}+ERR_{P5} \quad \text{Formula 2}$$

In Formula 1, each of the coupling-capacitance information $PAR_2$, $PAR_4$, $PAR_6$ and $PAR_8$ may be determined according to the property of the display panel 10 and/or according the maximum pixel voltage range VGR. For instance, in some embodiments, in Formula 1, the coupling-capacitance information $PAR_2$ is $(C_{P2P5}*VGR*P)/(RG*C_{P5})$, the coupling-capacitance information $PAR_4$ is $(C_{P4P5}*VGR*P)/(RG*C_{P5})$, the coupling-capacitance information $PAR_6$ is $(C_{P6P5}*VGR*P)/(RG*C_{P5})$, and the coupling-capacitance information $PAR_8$ is $(C_{P8P5}*VGR*P)/(RG*C_{P5})$, where $C_{P5}$ represents a storage capacitance value of the current pixel P5, $C_{P2P5}$ represents a coupling capacitance value between the current pixel P5 and the first adjacent pixel P2, $C_{P4P5}$ represents a coupling capacitance value between the current pixel P5 and the second adjacent pixel P4, $C_{P6P5}$ represents a coupling capacitance value between the current pixel P5 and the third adjacent pixel P6, $C_{P8P5}$ represents a coupling capacitance value between the current pixel P5 and the fourth adjacent pixel P8, P represents a polarity conversion coefficient, and RG represents a reference gray level value. The polarity conversion coefficient P is 1 or −1. When the frame with the positive polarity (i.e., the frame $F_{N-1}$) is changed to the frame with the negative polarity (i.e., the frame $F_N$), the polarity conversion coefficient P is 1. When the frame with the negative polarity (i.e., the frame $F_N$) is changed to the frame with the positive polarity (i.e., the frame $F_{N-1}$), the polarity conversion coefficient P is −1. If the application condition illustrated in FIG. 4 is taken as an example, the reference gray level value RG is 128.

It is assumed that the storage capacitance value $C_{P5}$ of the current pixel P5=20 fF, each of the coupling capacitance values $C_{P2P5}$, $C_{P4P5}$, $C_{P6P5}$ and $C_{P8P5}$ is 0.5 fF, and the maximum pixel voltage range VGR is 4V. It is assumed that the gray level of the current pixel P5 (current pixel data $M_{P5}$) is 128, and the gray level of each of the adjacent pixels P2, P4, P6 and P8 is 0. When the frame with the positive polarity (i.e., the frame $F_{N-1}$) is changed to the frame with the negative polarity (i.e., the frame $F_N$), a voltage variation of the adjacent pixel P2 with respect to the current pixel P5 is (VGR/128)(Q−M)*P=(VGR/128)(0−128)*1=−VGR. In the same way, a voltage variation of another adjacent pixel (P4, P6 or P8) with respect to the current pixel P5 is also −VGR. It is assumed that the coupling capacitance of each of the pixel P1, the pixel P3, the pixel P7 and the pixel P9 with respect to the pixel P5 may be disregarded from the calculation. By calculating using a capacitance formula, $C_{P5}*\Delta V_{P5}=C_{P2P5}*\Delta V_{P2P5}+C_{P4P5}*\Delta V_{P4P5}+C_{P6P5}*\Delta V_{P6P5}+C_{P8P5}*\Delta V_{P8P5}$, $\Delta V_{P2P5}$ is a voltage variation of the pixel P2 with respect to the pixel P5, $\Delta V_{P4P5}$ is a voltage variation of the pixel P4 with respect to the pixel P5, $\Delta P_{P6P5}$ is a voltage variation of the pixel P6 with respect to the pixel P5, and $\Delta V_{P8P5}$ is a voltage variation of the pixel P8 with respect to the pixel P5. $\Delta V_{P2P5}=\Delta V_{P4P5}=\Delta V_{P6P5}=\Delta V_{P8P5}=(VGR/128)(Q-M)*P=(4/128)(0-128)*1=-4$. Thus, the voltage variation of the pixel P5 caused by the coupling capacitance is $\Delta V_{P5}=(0.5/20)*(-4)+(0.5/20)*(-4)+(0.5/20)*(-4)+(0.5/20)*(-4)=-0.4V$. A unit gray level voltage VGRAY is VGR/255=4/255=15.7 mV. The voltage difference ($ERR_{P5}$) caused by a coupling effect is $\Delta V_{P5}/VGRAY=-0.4V/15.7\ mV\approx-25$. Namely, the coupling capacitance of each of the adjacent pixels P2, P4, P6 and P8 with respect to the current pixel P5 causes a voltage difference of −25 gray levels to the current pixel P5. Thus, the compensated pixel data $COMP_{P5}$ is $M_{P5}+25=128+25$, so as to compensate the difference caused by the coupling effect.

In another embodiment, the compensation circuit 130 may calculate a current pixel change of the current pixel P5 between the current frame $F_N$ and the previous frame $F_{N-1}$. The compensation circuit 130 may also calculate an adjacent pixel change of each of the adjacent pixels (e.g., pixels P2, P4, P6 and P8 illustrated in FIG. 3) between the current frame $F_N$ and the previous frame $F_{N-1}$. By using the coupling-capacitance information, and by using the current pixel change and the adjacent pixel changes, the compensation circuit 130 may compensate the current pixel data of the current pixel P5 $M_{P5}$ to obtain the compensated pixel data $COMP_{P5}$.

An application example of a dynamic image will be set forth hereinafter. Refer to FIG. 1, FIG. 3 and FIG. 4. The compensation circuit 130 may calculate Formula 3 to obtain the compensation value $ERR_{P5}$. By using the compensation value $ERR_{P5}$, the compensation circuit 130 may compensate the current pixel data $M_{P5}$ of the current pixel P5 to obtain the compensated pixel data $COMP_{P5}$, as illustrated by Formula 2. In Formula 3, $C_2$ represents the coupling-capacitance information between the current pixel P5 and the first adjacent pixel P2, $C_4$ represents the coupling-capacitance information between the current pixel P5 and the second adjacent pixel P4, $C_6$ represents the coupling-capacitance information between the current pixel P5 and the third adjacent pixel P6, $C_8$ represents the coupling-capacitance information between the current pixel P5 and the fourth adjacent pixel P8, $PV_5$ represents the current pixel change of the current pixel P5 between the current frame $F_N$ and the previous frame $F_{N-1}$, $PV_2$ represents the adjacent pixel change of the first adjacent pixel P2 between the current frame $F_N$ and the previous frame $F_{N-1}$, $PV_4$ represents the adjacent pixel change of the second adjacent pixel P4 between the current frame $F_N$ and the previous frame $F_{N-1}$, $PV_6$ represents the adjacent pixel change of the third adjacent pixel P6 between the current frame $F_N$ and the previous frame $F_{N-1}$, $PV_8$ represents the adjacent pixel change of the fourth adjacent pixel P8 between the current frame $F_N$ and the previous frame $F_{N-1}$, and $PAR_5$ is a real number. The value of $PAR_5$ may be determined based on a design requirement.

$$ERR_{P5}=C_2*(PV_2-PV_5)+C_4*(PV_4-PV_5)+C_6*(PV_6-PV_5)+C_8*(PV_8-PV_5)+PAR_5 \quad \text{Formula 3}$$

In Formula 3, each of the coupling-capacitance information $C_2$, $C_4$, $C_6$ and $C_8$ may be determined according to the property of the display panel 10 and/or according the maximum pixel voltage range VGR For instance, in some embodiments, in Formula 3, the coupling-capacitance information $C_2$ is $(GT/VGR)*(C_{P2P5}/C_{P5})$, the coupling-capacitance information $C_4$ is $(GT/VGR)*(C_{P4P5}/C_{P5})$, the coupling-capacitance information $C_6$ is $(GT/VGR)*(C_{P6P5}/C_{P5})$, and the coupling-capacitance information $C_8$ is $(GT/VGR)*(C_{P8P5}/C_{P5})$. GT represents a maximum gray level value range, VGR represents the maximum pixel voltage range, and $C_{P5}$ represents the storage capacitance value of the current pixel P5. If the application condition illustrated in FIG. 4 is taken as an example, the maximum gray level value range GT is 256, and the maximum pixel voltage range VGR is 4V.

In the frame with the positive polarity (e.g., the frame $F_{N-1}$ illustrated in FIG. 4), a voltage of the current pixel P5 is VGMA(128)+(VGR/2)*[(GT/2−$M_{P5(N-1)}$)/(GT/2)]*P, where the polarity conversion coefficient P is 1. $M_{P5(N-1)}$ represents the current pixel data of the current pixel P5 in the frame $F_{N-1}$. In the frame with the negative polarity (e.g., the frame $F_N$ illustrated in FIG. 4), the voltage of the current pixel P5 is VGMA(128)+(VGR/2)*[(GT/2−$M_{P5(N)}$)/(GT/2)]*P, where the polarity conversion coefficient P is −1. $M_{P5(N)}$ represents the current pixel data of the current pixel P5 in the frame $F_N$. Thus, the current pixel change $PV_5$ of the current pixel P5 is {VGMA(128)+(VGR/2)*[(GT/2−$M_{P5(N)}$)/(GT/2)]*(−1)}−{VGMA(128)+(VGR/2)*[(GT/2−$M_{P5(N-1)}$)/(GT/2)]}=(VGR/GT)*($M_{P5(N)}$+$M_{P5(N)}$+$M_{P5(N-1)}$) VGR.

In the frame with the positive polarity (e.g., the frame $F_{N-1}$ illustrated in FIG. 4), a voltage of the first adjacent pixel P2 is VGMA(128)+(VGR/2)*[(GT/2−$Q_{P2(N-1)}$)/(GT/2)]*P, where the polarity conversion coefficient P is 1. $Q_{P2(N-1)}$ represents the pixel data of the first adjacent pixel P2 in the frame $F_{N-1}$. In the frame with the negative polarity (e.g., the frame $F_N$ illustrated in FIG. 4), the voltage of the current pixel P5 is VGMA(128)+(VGR/2)*[(GT/2−$Q_{P2(N)}$)/(GT/2)]*P, where the polarity conversion coefficient P is −1. $Q_{P2(N)}$ represents pixel data of the first adjacent pixel P2 in the frame $F_N$. Thus, an adjacent pixel change $PV_2$ of the first adjacent pixel P2 is {VGMA(128)+(VGR/2)*[(GT/2−$Q_{P2(N)}$)/(GT/2)]*(−1)}−{VGMA(128)+(VGR/2)*[(GT/2−$Q_{P2(N-1)}$)/(GT/2)]}=(VGR/GT)*($Q_{P2(N)}$+$Q_{P2(N-1)}$)−VGR. The other adjacent pixels may be derived in the same way. The adjacent pixel change $PV_4$ of the second adjacent pixel P4 is (VGR/GT)*($Q_{P4(N)}$+$Q_{P4(N-1)}$)−VGR, the adjacent pixel change $PV_6$ of the third adjacent pixel P6 is (VGR/GT)*($Q_{P6(N)}$+$Q_{P6(N-1)}$)−VGR, and the adjacent pixel change $PV_8$ of the fourth adjacent pixel P8 is (VGR/GT)*($Q_{P8(N)}$+$Q_{P8(N-1)}$)−VGR. $Q_{P4(N)}$ represents pixel data of the second adjacent pixel P4 in the frame $F_N$, $Q_{P4(N-1)}$ represents pixel data of the second adjacent pixel P4 in the frame $F_{N-1}$, $Q_{P6(N)}$ represents pixel data of the third adjacent pixel P6 in the frame $F_N$, $Q_{P6(N-1)}$ represents pixel data of the third adjacent pixel P6 in the frame $F_{N-1}$, $Q_{P8(N)}$ represents pixel data of the fourth adjacent pixel P8 in the frame $F_N$, and $Q_{P8(N-1)}$ represents pixel data of the fourth adjacent pixel P8 in the frame $F_{N-1}$.

Figure 5:
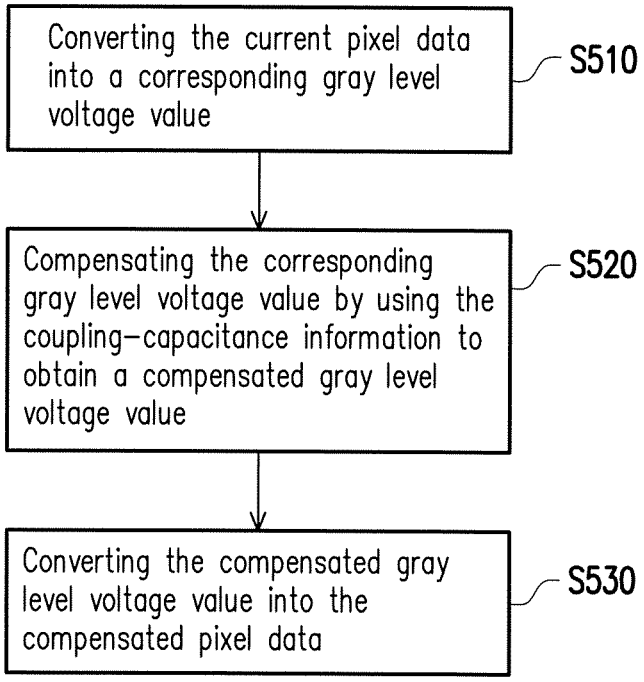
FIG. 5 is a schematic diagram illustrating the step of obtaining the compensated pixel data depicted in FIG. 2 according to an embodiment of the invention.

FIG. 5 is a schematic diagram illustrating step S230 of obtaining the compensated pixel data depicted in FIG. 2 according to an embodiment of the invention. In the embodiment illustrated in FIG. 5, step S230 includes steps S510, S520 and S530. In step S510, the compensation circuit 130 may convert the current pixel data of the current pixel P5 into a corresponding gray level voltage value. Based on some design requirements, the compensation circuit 130 convert the current pixel data into the corresponding gray level voltage value by using a lookup table, a conversion formula or an algorithm. In step S520, the compensation circuit 130 may compensate the corresponding gray level voltage value by using the coupling-capacitance information to obtain a compensated gray level voltage value. The compensation operation performed in step S520 may be derived with reference to the descriptions related to FIG. 3, FIG. 4, Formula 1, Formula 2 and/or Formula 3 and thus, will not be repeated. In step S530, the compensation circuit 130 may convert the compensated gray level voltage value into the compensated pixel data $COMP_{P5}$, so as to provide the compensated pixel data $COMP_{P5}$ to the data driving circuit 140. According to some design requirements, the compensation circuit 130 may convert the compensated gray level voltage value into the compensated pixel data $COMP_{P5}$ by using a lookup table, a conversion formula or an algorithm.

It should be noted that in some embodiments, the compensation circuit 130 may be a separate integrated circuit, and the memory 120 may be an additional integrated circuit. In some other embodiments, the memory 120 may be embedded in the compensation circuit 130. Based on a design requirement, the timing control circuit 110 and the data driving circuit 140 may be two separate integrated circuits, and the compensation circuit 130 may be embedded in the timing control circuit 110, or alternatively, the compensation circuit 130 may be embedded in the data driving circuit 140. In other embodiments, the timing control circuit 110, the compensation circuit 130 and the data driving circuit 140 may be together implemented in one integrated circuit.

In difference application scenarios, related functions of the timing control circuit 110, the memory 120, the compensation circuit 130 and/or the data driving circuit 140 may be implemented in a form of software, firmware or hardware by employing general programming languages (e.g., C or C++), hardware description languages (e.g., Verilog HDL or VHDL) or other suitable programming languages. The programming languages capable of executing the functions may be deployed in any computer-accessible media, such as magnetic tapes, semiconductor memories, magnetic disks or compact disks (e.g., CD-ROM or DVD-ROM) or may be delivered through the Internet, wired communication, wireless communication or other communication media. The programming languages may be stored in the computer-accessible media for a processor of the computer to access/execute the programming codes of the software (or firmware). For the hardware implementation, one or more controllers, micro-controllers, micro-processors, application-specific integrated circuits (ASICs), digital signal processors (DSPs), field programmable gate arrays (FPGAs) and/or logical blocks, modules and circuits in other processing units may be employed to implement or execute the aforementioned functions of the embodiments described herein. Moreover, the apparatus and the method of the invention may be implemented by means of a combination of hardware and software.

In light of the foregoing, in the display panel driving apparatus and the driving method of the embodiments of the invention, the memory can provide the coupling-capacitance information between the current pixel and the adjacent pixel in the display panel. By using the coupling-capacitance information, the compensation circuit can compensate the current pixel data of the current pixel to obtain the compensated pixel data of the current pixel P5. Thereby, the display panel driving apparatus 100 can compensate the voltage offset of the current pixel P5 caused by coupling voltages of the adjacent pixels.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A display panel driving apparatus, comprising:

a timing control circuit, configured to provide current pixel data of a current pixel in a display panel;

a memory, configured to provide at least one coupling-capacitance information between the current pixel and at least one adjacent pixel in the display panel, wherein at least one adjacent pixel comprises adjacent pixels belonging to the same row as the current pixel and adjacent pixels belonging to the same column as the current pixel;

a compensation circuit, coupled to the timing control circuit to receive the current pixel data, coupled to the memory to receive the coupling-capacitance information, and configured to compensate the current pixel data by using the at least one coupling-capacitance information to obtain compensated pixel data for compensating a voltage offset of the current pixel caused by a coupling voltage of the at least one adjacent pixel; and a data driving circuit, coupled to the current pixel of the display panel, coupled to the compensation circuit to receive the compensated pixel data, and configured to drive the current pixel according to the compensated pixel data.

2. The display panel driving apparatus according to claim 1, wherein the compensation circuit compensates the current pixel data by using the at least one coupling-capacitance information and by using at least one gray level difference between the at least one adjacent pixel and the current pixel to obtain the compensated pixel data.

3. The display panel driving apparatus according to claim 1, wherein the at least one adjacent pixel comprises a first adjacent pixel, a second adjacent pixel, a third adjacent pixel and a fourth adjacent pixel, and the compensation circuit calculates a formula, $ERR_{P5}=PAR_2*(M_{P5}-Q_{P2})+PAR_{52}+PAR_4*(M_{P5}-Q_{P4})+PAR_{54}+PAR_6*(M_{P5}-Q_{P6})+PAR_{56}+PAR_8*(M_{P5}-Q_{P8})+PAR_{58}+PAR_5$, to obtain a compensation value $ERR_{P5}$ and compensates current pixel data $M_{P5}$ by using the compensation value $ERR_{P5}$ to obtain the compensated pixel data, wherein $PAR_2$ represents the coupling-capacitance information between the current pixel and the first adjacent pixel, $PAR_4$ represents the coupling-capacitance information between the current pixel and the second adjacent pixel, $PAR_6$ represents the coupling-capacitance information between the current pixel and the third adjacent pixel, $PAR_8$ represents the coupling-capacitance information between the current pixel and the fourth adjacent pixel, $Q_{P2}$ represents pixel data of the first adjacent pixel, $Q_{P4}$ represents pixel data of the second adjacent pixel, $Q_{P6}$ represents pixel data of the third adjacent pixel, $Q_{P8}$ represents pixel data of the fourth adjacent pixel, and $PAR_{52}$, $PAR_{54}$, $PAR_{56}$, $PAR_{58}$ and $PAR_5$ are real numbers.

4. The display panel driving apparatus according to claim 3, wherein $PAR_2=(C_{P2P5}*VGR*P)/(RG*C_{P5})$, $PAR_4=(C_{P4P5}*VGR*P)/(RG*C_{P5})$, $PAR_6=(C_{P6P5}*VGR*P)/(RG*C_{P5})$, and $PAR_8=(C_{P8P5}*VGR*P)/(RG*C_{P5})$, wherein $C_{P5}$ represents a storage capacitance value of the current pixel, $C_{P2P5}$ represents a coupling capacitance value between the current pixel and the first adjacent pixel, $C_{P4P5}$ represents a coupling capacitance value between the current pixel and the second adjacent pixel, $C_{P6P5}$ represents a coupling capacitance value between the current pixel and the third adjacent pixel, $C_{P8P5}$ represents a coupling capacitance value between the current pixel and the fourth adjacent pixel, VGR represents a maximum pixel voltage range, P represents a polarity conversion coefficient, and RG represents a reference gray level value.

5. The display panel driving apparatus according to claim 1, wherein the compensation circuit calculates a current pixel change of the current pixel between a current frame and a previous frame, calculates at least one adjacent pixel change of the at least one adjacent pixel between the current frame and the previous frame, and compensates the current pixel data by using the at least one coupling-capacitance information, the current pixel change and the at least one adjacent pixel change to obtain the compensated pixel data.

6. The display panel driving apparatus according to claim 1, wherein the at least one adjacent pixel comprises a first adjacent pixel, a second adjacent pixel, a third adjacent pixel and a fourth adjacent pixel, the compensation circuit calculates a formula, $ERR_{P5}=C_2*(PV_2-PV_5)+C_4*(PV_4-PV_5)+C_6*(PV_6-PV_5)+C_8*(PV_8-PV_5)+PAR_5$, to obtain a compensation value $ERR_{P5}$, and compensates the current pixel data $M_{P5(N)}$ of the current pixel in a current frame by using the compensation value $ERR_{P5}$ to obtain the compensated pixel data, wherein $C_2$ represents the coupling-capacitance information between the current pixel and the first adjacent pixel, $C_4$ represents the coupling-capacitance information between the current pixel and the second adjacent pixel, $C_6$ represents the coupling-capacitance information between the current pixel and the third adjacent pixel, $C_8$ represents the coupling-capacitance information between the current pixel and the fourth adjacent pixel, $PV_5$ represents a current pixel change of the current pixel between the current frame and a previous frame, $PV_2$ represents an adjacent pixel change of the first adjacent pixel between the current frame and the previous frame, $PV_4$ represents an adjacent pixel change of the second adjacent pixel between the current frame and the previous frame, $PV_6$ represents an adjacent pixel change of the third adjacent pixel between the current frame and the previous frame, $PV_8$ represents an adjacent pixel change of the fourth adjacent pixel between the current frame and the previous frame, and $PAR_5$ is a real number.

7. The display panel driving apparatus according to claim 6, wherein $C_2=(GT/VGR)*(C_{P2P5}/C_{P5})$, $C_4=(GT/VGR)*(C_{P4P5}/C_{P5})$, $C_6=(GT/VGR)*(C_{P6P5}/C_{P5})$, $C_8=(GT/VGR)*(C_{P8P5}/C_{P5})$, $PV_5=(VGR/GT)*(M_{P5(N)}+M_{P5(N-1)})-VGR$, $PV_2=(VGR/GT)*(Q_{P2(N)}+Q_{P2(N-1)})-VGR$, $PV_4=(VGR/GT)*(Q_{P4(N)}+Q_{P4(N-1)})-VGR$, $PV_6=(VGR/GT)*(Q_{P6(N)}+Q_{P6(N-1)})-VGR$, and $PV_8=(VGR/GT)*(Q_{P8(N)}+Q_{P8(N-1)})-VGR$, wherein GT represents a maximum gray level value range, VGR represents a maximum pixel voltage range, $Cp_5$ represents a storage capacitance value of the current pixel, $C_{P2P5}$ represents a coupling capacitance value between the current pixel and the first adjacent pixel, $C_{P4P5}$ represents a coupling capacitance value between the current pixel and the second adjacent pixel, $C_{P6P5}$ represents a coupling capacitance value between the current pixel and the third adjacent pixel, $C_{P8P5}$ represents a coupling capacitance value between the current pixel and the fourth adjacent pixel, $M_{P5(N-1)}$ represents the current pixel data of the current pixel in a previous frame, $Q_{P2(N)}$ represents pixel data of the first adjacent pixel in the current frame, $Q_{P2(N-1)}$ represents pixel data of the first adjacent pixel in the previous frame, $Q_{P4(N)}$ represents pixel data of the second adjacent pixel in the current frame, $Q_{P4(N-1)}$ represents pixel data of the second adjacent pixel in the previous frame, $Q_{P6(N)}$ represents pixel data of the third adjacent pixel in the current frame, $Q_{P6(N-1)}$ represents pixel data of the third adjacent pixel in the previous frame, $Q_{P8(N)}$ represents pixel data of the fourth adjacent pixel in the current frame, and $Q_{P8(N-1)}$ represents pixel data of the fourth adjacent pixel in the previous frame.

8. The display panel driving apparatus according to claim 1, wherein the compensation circuit converts the current pixel data into a corresponding gray level voltage value, compensates the corresponding gray level voltage value by using the at least one coupling-capacitance information to obtain a compensated gray level voltage value, and converts the compensated gray level voltage value into the compensated pixel data.

9. A display panel driving method, comprising:

providing, by a timing control circuit, current pixel data of a current pixel in a display panel;

providing, by a memory, at least one coupling-capacitance information between the current pixel and at least one adjacent pixel in the display panel, wherein at least one adjacent pixel comprises adjacent pixels belonging to the same row as the current pixel and adjacent pixels belonging to the same column as the current pixel;

compensating, by a compensation circuit, the current pixel data by using the at least one coupling-capacitance information to obtain compensated pixel data for compensating a voltage offset of the current pixel caused by a coupling voltage of the at least one adjacent pixel; and driving, by a data driving circuit, the current pixel according to the compensated pixel data.

10. The display panel driving method according to claim 9, wherein the step of compensating the current pixel data comprises:

compensating, by the compensation circuit, the current pixel data by using the at least one coupling-capacitance information and by using at least one gray level difference between the at least one adjacent pixel and the current pixel to obtain the compensated pixel data.

11. The display panel driving method according to claim 9, where the at least one adjacent pixel comprises a first adjacent pixel, a second adjacent pixel, a third adjacent pixel and a fourth adjacent pixel, and the step of compensating the current pixel data comprises:

calculating, by the compensation circuit, a formula, $ERR_{P5}=PAR_2*(M_{P5}-Q_{P2})+PAR_{52}+PAR_4*(M_{P5}-Q_{P4})+PAR_{54}+PAR_6*(M_{P5}-Q_{P6})+PAR_{56}+PAR_8*(M_{P5}-Q_{P8})+PAR_{58}+PAR_5$, to obtain a compensation value $ERR_{P5}$, wherein $PAR_2$ represents the coupling-capacitance information between the current pixel and the first adjacent pixel, $PAR_4$ represents the coupling-capacitance information between the current pixel and the second adjacent pixel, $PAR_6$ represents the coupling-capacitance information between the current pixel and the third adjacent pixel, $PAR_8$ represents the coupling-capacitance information between the current pixel and the fourth adjacent pixel, $M_{P5}$ represents the current pixel data, $Q_{P2}$ represents pixel data of the first adjacent pixel, $Q_{P4}$ represents pixel data of the second adjacent pixel, $Q_{P6}$ represents pixel data of the third adjacent pixel, $Q_{P8}$ represents pixel data of the fourth adjacent pixel, and $PAR_{52}$, $PAR_{54}$, $PAR_{56}$, $PAR_{58}$ and $PAR_5$ are real numbers; and compensating the current pixel data $M_{P5}$ by using the compensation value $ERR_{P5}$ to obtain the compensated pixel data.

12. The display panel driving method according to claim 11, wherein $PAR_2=(C_{P2P5}*VGR*P)/(RG*C_{P5})$, $PAR_4=(C_{P4P5}*VGR*P)/(RG*C_{P5})$, $PAR_6=(C_{P6P5}*VGR*P)/(RG*C_{P5})$, and $PAR_8=(C_{P8P5}*VGR*P)/(RG*C_{P5})$, wherein $C_{P5}$ represents a storage capacitance value of the current pixel, $C_{P2P5}$ represents a coupling capacitance value between the current pixel and the first adjacent pixel, $C_{P4P5}$ represents a coupling capacitance value between the current pixel and the second adjacent pixel, $C_{P6P5}$ represents a coupling capacitance value between the current pixel and the third adjacent pixel, $C_{P8P5}$ represents a coupling capacitance value between the current pixel and the fourth adjacent pixel, VGR represents a maximum pixel voltage range, P represents a polarity conversion coefficient, and RG represents a reference gray level value.

13. The display panel driving method according to claim 9, wherein the step of compensating the current pixel data comprises:

calculating, by the compensation circuit, a current pixel change of the current pixel between a current frame and a previous frame;

calculating, by the compensation circuit, at least one adjacent pixel change of the at least one adjacent pixel between the current frame and the previous frame; and compensating, by the compensation circuit, the current pixel data by using the at least one coupling-capacitance information, the current pixel change and the at least one adjacent pixel change to obtain the compensated pixel data.

14. The display panel driving method according to claim 9, wherein the at least one adjacent pixel comprises a first adjacent pixel, a second adjacent pixel, a third adjacent pixel and a fourth adjacent pixel, and the step of compensating the current pixel data comprises:

calculating, by the compensation circuit, a formula, $ERR_{P5}=C_2*(PV_2-PV_5)+C_4*(PV_4-PV_5)+C_6*(PV_6-PV_5)+C_8*(PV_8-PV_5)+PAR_5$, to obtain a compensation value $ERR_{P5}$, wherein $C_2$ represents the coupling-capacitance information between the current pixel and the first adjacent pixel, $C_4$ represents the coupling-capacitance information between the current pixel and the second adjacent pixel, $C_6$ represents the coupling-capacitance information between the current pixel and the third adjacent pixel, $C_8$ represents the coupling-capacitance information between the current pixel and the fourth adjacent pixel, $PV_5$ represents a current pixel change of the current pixel between a current frame and a previous frame, $PV_2$ represents an adjacent pixel change of the first adjacent pixel between the current frame and the previous frame, $PV_4$ represents an adjacent pixel change of the second adjacent pixel between the current frame and the previous frame, $PV_6$ represents an adjacent pixel change of the third adjacent pixel between the current frame and the previous frame, $PV_8$ represents an adjacent pixel change of the fourth adjacent pixel between the current frame and the previous frame, and $PAR_5$ is a real number; and compensating, by the compensation circuit, the current pixel data $M_{P5(N)}$ of the current pixel in the current frame by using the compensation value $ERR_{P5}$ to obtain the compensated pixel data.

15. The display panel driving method according to claim 14, wherein $C_2=(GT/VGR)*(C_{P2P5}/C_{P5})$, $C_4=(GT/VGR)*(C_{P4P5}/C_{P5})$, $C_6=(GT/VGR)*(C_{P6P5}/C_{P5})$, $C_8=(GT/VGR)*(C_{P8P5}/C_{P5})$, $PV_5=(VGR/GT)*(M_{P5(N)}+M_{P5(N-1)})-VGR$, $PV_2=(VGR/GT)*(Q_{P2(N)}+Q_{P2(N-1)})-VGR$, $PV_4=(VGR/GT)*(Q_{P4(N)}+Q_{P4(N-1)})-VGR$, $PV_6=(VGR/GT)*(Q_{P6(N)}+Q_{P6(N-1)})-VGR$, and $PV_8=(VGR/GT)*(Q_{P8(N)}+Q_{P8(N-1)})-VGR$, wherein GT represents a maximum gray level value range, VGR represents a maximum pixel voltage range, $C_{P5}$ represents a storage capacitance value of the current pixel, $C_{P2P5}$ represents a coupling capacitance value between the current pixel and the first adjacent pixel, $C_{P4P5}$ represents a coupling capacitance value between the current pixel and the second adjacent pixel, $C_{P6P5}$ represents a coupling capacitance value between the current pixel and the third adjacent pixel, $C_{P8P5}$ represents a coupling capacitance value between the current pixel and the fourth adjacent pixel, $M_{P5(N-1)}$ represents the current pixel data of the current pixel in a previous frame, $Q_{P2(N)}$ represents pixel data of the first adjacent pixel in the current frame, $Q_{P2(N-1)}$ represents pixel data of the first adjacent pixel in the previous frame, $Q_{P4(N)}$ represents pixel data of the second adjacent pixel in the current frame, $Q_{P4(N-1)}$ represents pixel data of the second adjacent pixel in the previous frame, $Q_{P6(N)}$ represents pixel data of the third adjacent pixel in the current frame, $Q_{P6(N-1)}$ represents pixel data of the third adjacent pixel in the previous frame, $Q_{P8(N)}$ represents pixel data of the fourth adjacent pixel in the current frame, and $Q_{P8(N-1)}$ represents pixel data of the fourth adjacent pixel in the previous frame.

16. The display panel driving method according to claim 9, wherein the step of obtaining the compensated pixel data comprises:

converting, by the compensation circuit, the current pixel data into a corresponding gray level voltage value;

compensating, by the compensation circuit, the corresponding gray level voltage value by using the at least one coupling-capacitance information to obtain a compensated gray level voltage value; and converting, by the compensation circuit, the compensated gray level voltage value into the compensated pixel data.

* * * * *